US007615186B2

(12) United States Patent
Suda et al.

(10) Patent No.: US 7,615,186 B2
(45) Date of Patent: Nov. 10, 2009

(54) SPRING STEEL EXCELLENT IN SAG RESISTANCE AND FATIGUE PROPERTY

(75) Inventors: Sumie Suda, Kobe (JP); Nobuhiko Ibaraki, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 164 days.

(21) Appl. No.: 10/550,019

(22) PCT Filed: Mar. 25, 2004

(86) PCT No.: PCT/JP2004/004181

§ 371 (c)(1),
(2), (4) Date: Sep. 23, 2005

(87) PCT Pub. No.: WO2004/087977

PCT Pub. Date: Oct. 14, 2004

(65) Prior Publication Data

US 2007/0163680 A1 Jul. 19, 2007

(30) Foreign Application Priority Data

Mar. 28, 2003 (JP) ..... 2003-092599

(51) Int. Cl.
*C22C 38/18* (2006.01)
*C22C 38/00* (2006.01)

(52) U.S. Cl. ..... 420/104; 148/333

(58) Field of Classification Search ..... 148/318, 148/333; 420/104
See application file for complete search history.

(56) References Cited

U.S. PATENT DOCUMENTS

| | | | |
|---|---|---|---|
| 5,183,634 | A | 2/1993 | Abe et al. |
| 5,508,002 | A | 4/1996 | Kawaguchi et al. |
| 6,017,641 | A | 1/2000 | Aoki et al. |
| 6,074,496 | A | 6/2000 | Yarita et al. |
| 6,338,763 | B1 | 1/2002 | Hashimura et al. |
| 2003/0024610 | A1 | 2/2003 | Ibakaki et al. |

FOREIGN PATENT DOCUMENTS

| | | | |
|---|---|---|---|
| EP | 0 462 779 | A2 | 12/1991 |
| EP | 0 657 557 | A1 | 6/1995 |
| JP | 62-177152 | | 8/1987 |
| JP | 63-153240 | | 6/1988 |
| JP | 6-228734 | | 8/1994 |
| JP | 8-170152 | | 7/1996 |
| JP | 2650225 | | 5/1997 |
| JP | 2000-169937 | | 6/2000 |
| JP | 2000-326036 | | 11/2000 |
| JP | 2002-212665 | | 7/2002 |
| WO | WO 03/083151 | | 10/2003 |

*Primary Examiner*—Roy King
*Assistant Examiner*—Caitlin Fogarty
(74) *Attorney, Agent, or Firm*—Oblon, Spivak, McClelland, Maier & Neustadt, L.L.P.

(57) ABSTRACT

The spring steel according to the present invention is a spring steel excellent in sag resistance and fatigue property containing: C: 0.5 to 0.8% by mass (hereinafter, referred to as %), Si: 1.2 to 2.5%, Mn: 0.2 to 1.5%, Cr: 1.0 to 4.0%, V: 0.5% or less (including 0%), P: 0.02% or less (excluding 0%), S: 0.02% or less (excluding 0%), Al: 0.05% or less (excluding 0%), and Fe and inevitable impurities as the balance, wherein the Si content and the Cr content satisfy the following formula (1):

$$0.8\times[Si]+[Cr]\geqq 2.6 \quad (1)$$

(wherein, [Si] and [Cr] respectively represent the Si content (%) and the Cr content (%)).

The spring steel is useful in improving both sag resistance and fatigue property.

14 Claims, 1 Drawing Sheet

SPRING STEEL EXCELLENT IN SAG RESISTANCE AND FATIGUE PROPERTY

TECHNICAL FIELD

The present invention relates to a spring steel excellent in sag resistance and fatigue property useful for use in producing springs (for example, springs for use as restoration mechanisms in machineries).

BACKGROUND ART

In the recent trend toward further reduction in weight and enhancement in power of automobiles, valve springs for automobile engine, suspension springs for suspension, clutch springs, brake springs or the like are requested to be designed for withstanding higher stress. Namely, there is a demand for springs excellent in sag resistance and fatigue property, along with the increase in loaded stress on the springs.

Sag resistance is known to be improved by strengthening of spring material. Because sag resistance is improved by strengthening, for example, by adding Si in a greater amount, Si is normally used in an amount in the range of approximately 0.8 to 2.5% (Japanese Patent No. 2898472, Japanese unexamined patent publication No. 2000-169937 and others). In addition, strengthening of spring material would be effective in improving fatigue property, from the point of fatigue limit. However, when a spring material is strengthened, the defect sensitivity of the spring tends to be high, and that sometimes makes the fatigue life of the spring shorten and often involves breakage of the spring during coiling. Thus, it is quite difficult to improve both sag resistance and fatigue property at the same time.

An object of the present invention, which was made under the circumstances above, is to provide a steel useful in producing springs capable of improving both sag resistance and fatigue property.

DISCLOSURE OF THE INVENTION

During intensive studies to solve the problems above, the inventors have found an unexpected function of Cr. Namely, although Cr, an element effective in enhancing hardenability and temper softening resistance, is also known to be effective in improving sag resistance and fatigue limit similarly to Si, use of Cr in a greater amount resulted in no improvement of fatigue life but rather in deterioration in toughness and ductility, and thus, use of Cr is kept at a substantially lower amount of about 1% (see Examples in the above Patent Documents). However, the inventors have found that Cr has an function to improve fatigue strength and sag resistance without increasing defect sensitivity. More specifically, while a spring has been produced from a steel material (wire rod), for example, in the processes of wire drawing, oil tempering, coiling, shot peening, presetting, and others in this order, the shot peening, in particular, is important in applying a residual compression stress on the surface and thus improving the fatigue life of the spring. However, when the Cr content in a steel material is larger, oxidation occurs along the grain boundaries during oil tempering, and this intergranular oxidation layer reduces the amount of the residual compression stress applied during shot peening, consequently prohibiting improvement in fatigue life. The inventors have found that it is possible to use the potential function of Cr decreasing the defect sensitivity more effectively and thus to prevent shortening of the fatigue life even when defects exist, by controlling the intergranular oxidation during oil tempering.

In addition, the inventors conducted additional research and development. That is, although some improvements in fatigue life were recognized by reducing the intergranular oxidation layer of a steel wire containing Cr in a particular amount or more, there was still room for further improvement. As a result, the inventors found that it is possible to improve the fatigue property further by optimizing the content balance of Si and Cr in steel material, and completed the present invention.

Namely, the spring steel excellent in sag resistance and fatigue property according to the present invention contains: C: 0.5 to 0.8% by mass (hereinafter, referred to as %), Si: 1.2 to 2.5%, Mn: 0.2 to 1.5%, Cr: 1.0 to 4.0%, V: 0.5% or less (including 0%), P: 0.02% or less (excluding 0%), S: 0.02% or less (excluding 0%), Al: 0.05% or less (excluding 0%), and Fe and inevitable impurities as the balance, wherein the Si content and the Cr content satisfy the following formula (1):

$$0.8\times[Si]+[Cr]\geqq 2.6 \quad (1)$$

(wherein, [Si] and [Cr] respectively represent the Si content (%) and the Cr content (%)).

More accurately, the "spring steel" means a wire rod produced, for example, by hot rolling. The spring steel according to the present invention preferably contains: Mn: 0.5% or more; or Cr: 1.3% or more. The spring steel may further contain: Ni: 0.5% or less (excluding 0%); and/or Mo: 0.4% or less (excluding 0%).

BEST MODE OF CARRYING OUT THE INVENTION

Figure 1:
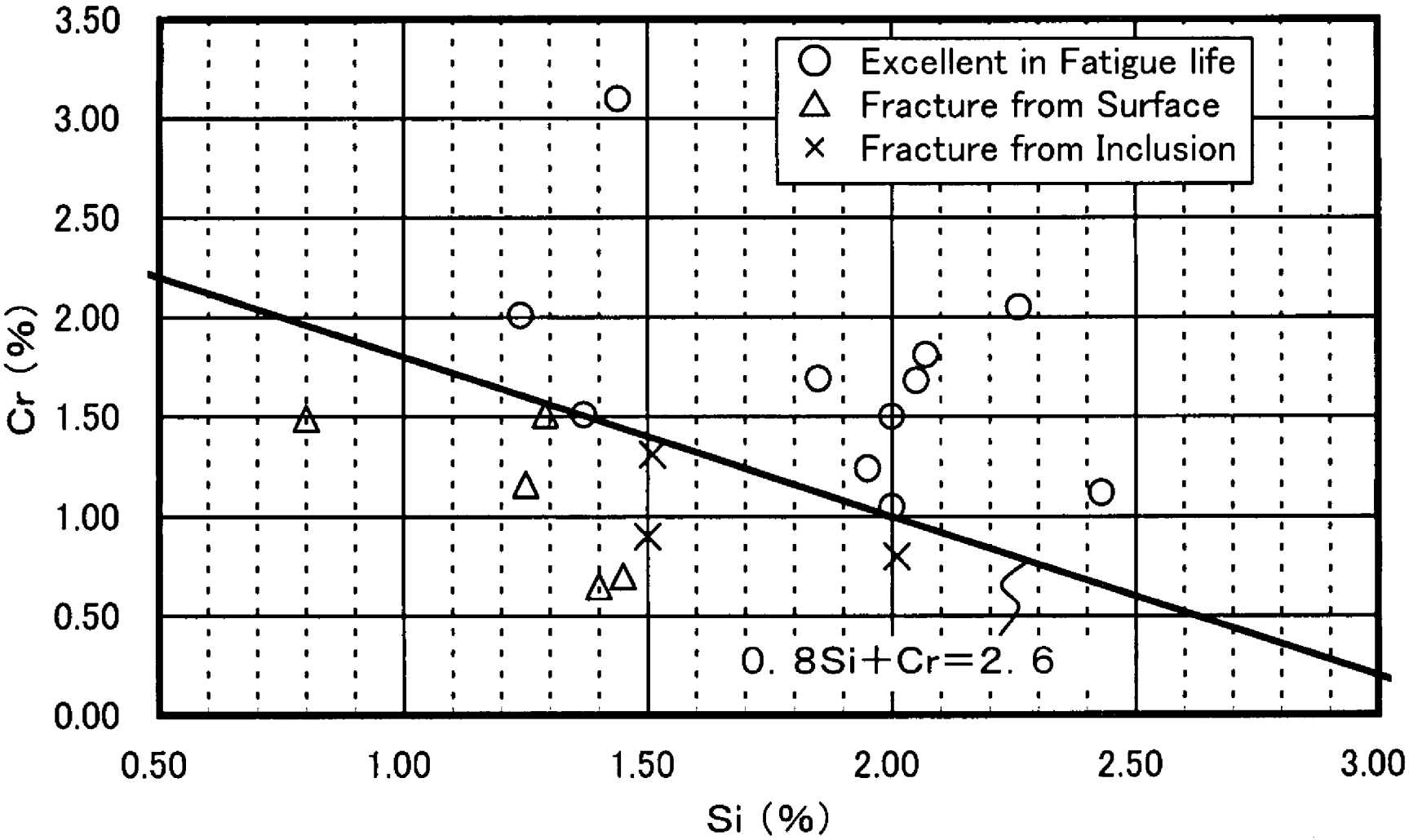
FIG. 1 is a graph showing the relationship among the Si content, the Cr content and the fatigue property of the steel in Examples.

The inventive steel contains C, Si, Mn, Cr, V, P, S, and Al respectively in particular amounts as well as Fe and inevitable impurities as the balance. Hereinafter, the content of each chemical composition and its reasons of limitation will be described.

C: 0.5 to 0.8% by Mass (Hereinafter, Referred to as %)

C is an element added to provide a spring to which high stress is loaded with sufficient strength and is normally added in an amount of approximately 0.5% or more, preferably 0.52% or more, more preferably approximately 0.54% or more, and particularly preferably approximately 0.6% or more. However, addition in an excessive amount leads to deterioration in toughness and ductility, and more frequent generation of cracks originating from surface flaws or internal defects during processing of the spring steel into spring or during use of the spring obtained, and thus the content is normally approximately 0.8% or less, preferably approximately 0.75% or less, and more preferably approximately 0.7% or less.

Si: 1.2 to 2.5%

Si is an element needed as a deoxidizer during steel making and useful in improving softening resistance and sag resistance. Si is normally added in an amount of approximately 1.2% or more, preferably approximately 1.4% or more, and more preferably approximately 1.6% or more, to make these effects exhibited more effectively. However, addition in an excessive amount leads to deterioration in toughness and ductility, increase in the number of flaws, acceleration of the progress of surface decarburization during heat treatment, thickening of the intergranular oxidation layer and thus shortening of fatigue life. The content of Si is normally approximately 2.5% or less, preferably approximately 2.3% or less, and more preferably approximately 2.2% or less.

Mn: 0.2 to 1.5%

Mn is an element effective in deoxidizing steel during steel making and improving the hardenability and thus strengthening. Mn is added in an amount of normally approximately 0.2% or more, preferably 0.3% or more, more preferably 0.4% or more, and particularly preferably approximately 0.5% or more (for example, approximately 0.6% or more, preferably approximately 0.65% or more), to make these effects exhibited more effectively. However, the steel according to the present invention is made into spring in the steps of hot rolling, patenting as needed, wire drawing, oil tempering, coiling and the like, so that presence of an excessive amount of Mn leads to more frequent formation of supercooled structures such as bainite during the hot rolling or the patenting treatment and to more frequent deterioration in wire drawability. Thus, the upper limit of the Mn content is normally approximately 1.5%, preferably approximately 1.2%, and more preferably approximately 1%.

Cr: 1.0 to 4.0%

Cr is an important element in the present invention that has functions in improving sag resistance and lowering defect sensitivity. Although Cr also has a function to thicken the intergranular oxidation layer and to shorten fatigue life, such an adverse function can be avoided in the present invention, because it is possible to thin the intergranular oxidation layer by controlling the atmosphere during oil tempering. Accordingly, the content of Cr is preferably as much as possible, and for example, 1.0% or more, preferably 1.03% or more, more preferably 1.2% or more, and particularly preferably 1.3% or more. In addition, presence of Cr in a greater amount improves the sag resistance after surface hardening (for example, nitriding treatment). A Cr content of 1.3% or more, preferably 1.4% or more, and more preferably 1.5% or more, is recommended for improving the sag resistance after surface hardening. Because presence of an excessive amount of Cr leads to overlong patenting period before wire drawing and deterioration in toughness and ductility, the content of Cr is 4.0% or less, preferably 3.5% or less, more preferably 3% or less, and particularly preferably 2.6% or less.

V: 0.5% or Less (Including 0%)

Although V may not be added (0%), V has a function to make grains fine during oil tempering after wire drawing of the steel according to the present invention, and is useful in improving toughness and ductility, and also in strengthening of the steel due to secondary precipitation hardening during the oil tempering or stress relief annealing after coiling (spring forming). Thus, V may be added, for example, approximately 0.01% or more, preferably approximately 0.05% or more, and more preferably approximately 0.1% or more. However, excessive addition thereof often leads to formation of martensite or bainite structures in the steel in the steps before oil tempering and thus deterioration in wire drawability, the content of V if added (more than 0%) is approximately 0.5% or less, preferably approximately 0.4% or less, and more preferably approximately 0.3% or less.

P: 0.02% or Less (Excluding 0%)

S: 0.02% or Less (Excluding 0%)

P and S are impurity elements that reduce toughness and ductility of steel, and thus, these contents are preferably reduced as much as possible, for prevention of breakage in wire drawing. The P content and the S content are preferably 0.015% or less, and more preferably approximately 0.013% or less, respectively. The upper limit of the P content and that of the S content may be set different from each other.

Al: 0.05% or Less (Excluding 0%)

Al may not be needed, for example, when a steel is deoxidized with other elements (e.g., Si) or is processed under vacuum, but Al is useful when the steel is Al-killed. However, the content of Al is preferably as low as possible, because Al generates oxides such as $Al_2O_3$ and the like, which cause breakage during wire drawing and become initiation points of fracture leading to deterioration in fatigue property of a spring. The content of Al is preferably 0.03% or less, more preferably 0.01% or less, and particularly preferably approximately 0.005% or less.

In the present invention, Ni, Mo and the like may be added alone or in combination of two or more in addition to the elements above. Hereinafter, the contents of these selected elements and the reasons for addition will be described.

Ni: 0.5% or Less (Excluding 0%)

Ni is an element effective in enhancing hardenability and preventing low-temperature embrittlement. The content of Ni is preferably approximately 0.05% or more, preferably approximately 0.1% or more, and more preferably approximately 0.15% or more. However, presence of an excessive amount thereof results in formation of bainite or martensite structures in producing steel materials by hot rolling, leading to deterioration in the toughness and ductility of the steel, and thus the content of Ni is approximately 0.5% or less, preferably approximately 0.4% or less, and more preferably approximately 0.3% or less.

Mo: 0.4% or Less (Excluding 0%)

Mo is useful in improving softening resistance and in raising the yield stress by precipitation hardening after low-temperature annealing. The content of Mo is preferably 0.05% or more and more preferably 0.1% or more. However, addition in an excessive amount results in formation of martensite or bainite structures in the steps before the oil tempering of the steel according to the present invention and deterioration in wire drawability, and thus, the content thereof is 0.4% or less, preferably 0.35% or less, and more preferably 0.30% or less.

In the steel according to the present invention, every chemical composition above is controlled respectively in the ranges above, and in addition, the content balance of Si and Cr is also controlled in a suitable manner, specifically, satisfying the following formula (1) and preferably the following formula (2):

$$0.8\times[Si]+[Cr]\geqq 2.6 \quad (1)$$

$$0.8\times[Si]+[Cr]\geqq 3.0 \quad (2)$$

(wherein, [Si] and [Cr] respectively represent the Si content (%) and the Cr content (%)).

It is possible to improve the defect sensitivity of the resulting spring securely and elongate its fatigue life further by controlling the content balance of Si and Cr properly.

The steel according to the present invention is obtained, for example, as a billet, an ingot or a wire rod produced by hot rolling them. The steel according to the present invention is made into spring, for example, by the followings.

Namely, the wire rod above is further processed by wire drawing, quenching and tempering (e.g., oil tempering) into a steel wire, which is then formed into a spring. The quenching and tempering are preferably performed under a gas atmosphere containing steam. The quenching and tempering under a steam-containing gas atmosphere make fine the oxide film on the steel wire surface and thin the intergranular oxidation layer, and thus the problems associated with addition of Cr are eliminated.

The wire rod is normally processed, for example, in softening annealing, shaving, lead patenting treatments and others before wire drawing. In addition, after spring formation, the spring is normally subjected to stress relief annealing, dual shot peening, low temperature annealing, presetting, and the like.

The steel according to the present invention, which contains Si and Cr in particular amounts or more, and whose content balance of Si and Cr is properly controlled, provides a spring improved in sag resistance and also reliably enhanced in fatigue property.

EXAMPLES

Hereinafter, the present invention will be described more specifically with Examples, but it should be understood that the present invention is not restricted by the following Examples and all modifications that may be conducted in the scope of the descriptions above and below are also included in the technical scope of the present invention.

Examples 1 to 19

Steels containing the chemical compositions shown in the following Table 1 were melt and hot-rolled into steel wire rods having a diameter of 8.0 mm.

To evaluate the properties of the steel wire rods when used in spring applications, the following tests were performed.

[Fatigue Property]

The steel wire rods were processed by softening annealing, shaving, lead patenting (heating temperature: 950° C., lead furnace temperature: 620° C.) and wire drawing, then, by oil tempering (heating temperature: 960° C., quenching oil temperature: 70° C., tempering temperature: 450° C., cooling condition after tempering: air cooling, furnace atmosphere: 10 vol. % $H_2O$+90 vol. % $N_2$), to give oil tempered wires having a diameter of 4.0 mm.

The oil tempered wires obtained were further tempered at a temperature of 400° C. for 20 minutes, which corresponds to the condition of stress relief annealing, and then processed by dual shot peening and low temperature annealing (220° C.×20 minutes). The low-temperature annealed steel wires were placed in TYPE 4 Nakamura-type rotary bending fatigue tester manufactured by Shimadzu Corporation; rotary bending fatigue tests were performed under the condition of a rotational speed of 4,000 rpm, a test piece length of 600 mm and a nominal stress of 826 MPa; thus, lifetimes (number of cycles) until breakage and fracture surfaces were investigated. When the steel wire was not broken, the test was discontinued at the number of $2\times10^7$cycles.

[Sag Resistance]

Oil tempered wires prepared same as the fatigue property test were processed into springs (spring constant: 2.6 kgf/mm), by spring-forming (average coil diameter: 28.0 mm, total number of coils: 6.5, number of active coils: 4.5), stress relief annealing (400° C.×20 minutes), seat position grinding, dual shot peening, low temperature annealing (230° C.×20 minutes) and presetting. Springs were separately prepared in a similar manner to above except that the oil tempered wires were subjected to a nitriding treatment (temperature 450° C.×3 hours) before shot peening.

The residual shear strains of the springs with or without the nitriding treatment were determined as follows: the spring was clamped under a stress of 1,372 MPa continuously over a period of 48 hours (temperature: 120° C.); after relief of the stress, the amounts of the sag resistance before and after the test were determined, and the residual shear strains were calculated.

Separately, the grain size numbers of prior austenite were determined according to the method of JIS G0551. Results are summarized in Table 1 and also shown in FIG. 1. In FIG. 1, ○ corresponds to Examples 1 to 11, Δ to Examples 12 to 13, 15 to 16 and 19, and × to Examples 14, and 17 to 18.

TABLE 1

| | Chemical compositions (% by mass)* | | | | | | | | | | Grain size |
|---|---|---|---|---|---|---|---|---|---|---|---|
| Examples | C | Si | Mn | P | S | Ni | Cr | V | Mo | Al | number |
| 1 | 0.75 | 2.00 | 0.75 | 0.010 | 0.009 | 0.00 | 1.50 | 0.21 | 0.00 | 0.003 | 10.5 |
| 2 | 0.60 | 1.95 | 0.69 | 0.008 | 0.007 | 0.00 | 1.24 | 0.32 | 0.00 | 0.002 | 10.5 |
| 3 | 0.59 | 1.44 | 0.68 | 0.008 | 0.011 | 0.00 | 3.10 | 0.18 | 0.00 | 0.002 | 11.0 |
| 4 | 0.53 | 2.07 | 1.22 | 0.005 | 0.006 | 0.00 | 1.81 | 0.11 | 0.00 | 0.002 | 11.0 |
| 5 | 0.72 | 1.85 | 0.85 | 0.006 | 0.011 | 0.18 | 1.69 | 0.24 | 0.00 | 0.003 | 10.5 |
| 6 | 0.52 | 2.26 | 0.94 | 0.008 | 0.005 | 0.00 | 2.05 | 0.23 | 0.28 | 0.035 | 10.0 |
| 7 | 0.61 | 2.00 | 0.85 | 0.013 | 0.005 | 0.25 | 1.05 | 0.11 | 0.00 | 0.001 | 10.5 |
| 8 | 0.78 | 1.24 | 0.67 | 0.007 | 0.008 | 0.00 | 2.01 | 0.16 | 0.00 | 0.003 | 11.0 |
| 9 | 0.63 | 2.43 | 0.71 | 0.009 | 0.007 | 0.43 | 1.12 | 0.12 | 0.00 | 0.003 | 10.5 |
| 10 | 0.61 | 2.05 | 0.32 | 0.008 | 0.010 | 0.00 | 1.68 | 0.27 | 0.00 | 0.002 | 12.0 |
| 11 | 0.68 | 1.37 | 0.47 | 0.015 | 0.012 | 0.00 | 1.51 | 0.17 | 0.00 | 0.003 | 11.5 |
| 12 | 0.55 | 1.45 | 0.70 | 0.010 | 0.009 | 0.00 | 0.70 | 0.00 | 0.00 | 0.003 | 9.5 |
| 13 | 0.63 | 1.40 | 0.60 | 0.007 | 0.012 | 0.00 | 0.65 | 0.11 | 0.00 | 0.003 | 10.0 |
| 14 | 0.60 | 1.50 | 0.70 | 0.011 | 0.010 | 0.25 | 0.90 | 0.06 | 0.00 | 0.041 | 10.0 |
| 15 | 0.59 | 1.29 | 0.75 | 0.008 | 0.014 | 0.00 | 1.51 | 0.00 | 0.09 | 0.002 | 10.5 |
| 16 | 0.72 | 0.80 | 0.78 | 0.006 | 0.009 | 0.00 | 1.49 | 0.05 | 0.15 | 0.002 | 11.0 |
| 17 | 0.65 | 2.01 | 0.90 | 0.005 | 0.005 | 0.00 | 0.80 | 0.15 | 0.00 | 0.001 | 10.0 |
| 18 | 0.59 | 1.51 | 0.83 | 0.007 | 0.012 | 0.00 | 1.31 | 0.23 | 0.00 | 0.003 | 10.5 |
| 19 | 0.68 | 1.25 | 1.22 | 0.011 | 0.009 | 0.00 | 1.16 | 0.35 | 0.00 | 0.003 | 10.5 |

TABLE 1-continued

| Examples | Calculated 0.8Si + Cr | Fatigue life (× $10^6$ cycles) | Initiation of fracture | Residual shear strain (%) | Residual shear strain after nitriding (%) |
|---|---|---|---|---|---|
| 1 | 3.1 | 20 | — | 0.041 | 0.038 |
| 2 | 2.8 | 20 | — | 0.037 | 0.051 |
| 3 | 4.3 | 20 | — | 0.029 | 0.030 |
| 4 | 3.5 | 20 | — | 0.045 | 0.039 |
| 5 | 3.2 | 20 | — | 0.025 | 0.033 |
| 6 | 3.9 | 20 | — | 0.038 | 0.029 |
| 7 | 2.7 | 20 | — | 0.047 | 0.059 |
| 8 | 3.0 | 20 | — | 0.033 | 0.041 |
| 9 | 3.1 | 20 | — | 0.041 | 0.063 |
| 10 | 3.3 | 20 | — | 0.029 | 0.031 |
| 11 | 2.6 | 20 | — | 0.039 | 0.041 |
| 12 | 1.9 | 5.0 | Surface | 0.075 | 0.079 |
| 13 | 1.8 | 7.8 | Surface | 0.064 | 0.081 |
| 14 | 2.1 | 7.0 | Oxide inclusions | 0.065 | 0.075 |
| 15 | 2.5 | 10.3 | Surface | 0.059 | 0.059 |
| 16 | 2.1 | 4.3 | Surface | 0.084 | 0.081 |
| 17 | 2.4 | 1.7 | Oxide inclusions | 0.049 | 0.055 |
| 18 | 2.5 | 8.3 | Oxide inclusions | 0.055 | 0.055 |
| 19 | 2.2 | 12.7 | Surface | 0.102 | 0.105 |

*The balance is Fe and inevitable impurites.

As apparent from Table 1 and FIG. 1, the spring steels obtained in Examples 12 to 14 and 16 to 17 have shorter fatigue lifes because of shortage of at least Si or Cr. As shown in Examples 15 and 18 to 19, the spring steels added with Si and Cr in particular amounts or more were improved in fatigue life over the spring steels obtained in Examples 12 to 14 and 16 to 17, but demand further improvement in fatigue life, for example, a fracture (a fracture below fatigue limit) originating from oxide inclusions occurred in Example 18.

In contrast, as shown in Examples 1 to 11, the spring steels containing Si and Cr respectively in particular amounts or more and having a properly controlled content balance of Si and Cr were improved significantly in fatigue life and also the springs were improved in sag resistance. In particular, the springs obtained in Examples 1, 3 to 6, 8, and 10 to 11, which contain Cr in an amount greater than those of the springs in Examples 2, 7, and 9, were also improved in the sag resistance after nitriding.

INDUSTRIAL APPLICABILITY

The steel according to the present invention allows reliable improvement both in sag resistance and fatigue property of a spring formed as described above.

What is claimed is:

1. A spring steel comprising:

C: 0.5 to 0.8% by mass (hereinafter, referred to as %),

Si: 1.2 to 2.5%,

Mn: 0.2 to 1.5%,

Cr: 1.5 to 4.0%,

V: 0.5% or less including 0%,

P: 0.02% or less excluding 0%,

S: 0.02% or less excluding 0%,

Al: 0.01% or less excluding 0%, and

Fe and inevitable impurities, wherein the Si content and the Cr content satisfy the following formula (2):

$$(0.8\times[Si])+[Cr]\geqq 3.0 \quad (2)$$

wherein, [Si] and [Cr] respectively represent the Si content (%) and the Cr content (%).

2. The spring steel according to claim 1, wherein the Mn content is 0.5% to 1.5%.

3. The spring steel according to claim 1, wherein the Cr content is 1.5 to 2.6%.

4. The spring steel according to claim 1, further comprising at least one selected from Ni: 0.5% or less excluding 0% and Mo: 0.4% or less excluding 0%.

5. The spring steel according to claim 1, wherein the V content is 0.05 to 0.5%.

6. The spring steel according to claim 5, wherein the Mn content is 0.5% to 1.5%.

7. The spring steel according to claim 5, wherein the Cr content is 1.5 to 2.6%.

8. The spring steel according to claim 5, further comprising at least one selected from:

Ni: 0.5% or less excluding 0%, and

Mo: 0.4% or less excluding 0%.

9. The spring steel according to claim 1, consisting essentially of:

C: 0.5 to 0.8%,

Si: 1.2 to 2.5%,

Mn: 0.2 to 1.5%,

Cr: 1.5 to 4.0%,

V: 0.5% or less including 0%,

P: 0.02% or less excluding 0%,

S: 0.02% or less excluding 0%,

Al: 0.01% or less excluding 0%, and

Fe and inevitable impurities.

10. The spring steel according to claim 5, consisting essentially of:

C: 0.5 to 0.8%,

Si: 1.2 to 2.5%,

Mn: 0.2 to 1.5%,

Cr: 1.5 to 4.0%,

V: 0.05 to 0.5%

P: 0.02% or less excluding 0%,

S: 0.02% or less excluding 0%,

Al: 0.01% or less excluding 0%, and

Fe and inevitable impurities.

11. The spring steel according to claim 8, consisting essentially of:

C: 0.5 to 0.8%,

Si: 1.2 to 2.5%,

Mn: 0.2 to 1.5%,
Cr: 1.5 to 4.0%,
V: 0.05 to 0.5%
P: 0.02% or less excluding 0%,
S: 0.02% or less excluding 0%,
Al: 0.01% or less excluding 0%,
Ni: 0.5% or less excluding 0%,
Mo: 0.4% or less excluding 0%, and
Fe and inevitable impurities.

12. The spring steel according to claim 1, consisting of:
C: 0.5 to 0.8%,
Si: 1.2 to 2.5%,
Mn: 0.2 to 1.5%,
Cr: 1.5 to 4.0%,
V: 0.5% or less excluding 0%,
P: 0.02% or less excluding 0%,
S: 0.02% or less excluding 0%,
Al: 0.01% or less excluding 0%, and
Fe and inevitable impurities.

13. The spring steel according to claim 5, consisting of:
C: 0.5 to 0.8%,
Si: 1.2 to 2.5%,
Mn: 0.2 to 1.5%,
Cr: 1.5 to 4.0%,
V: 0.05 to 0.5%
P: 0.02% or less excluding 0%,
S: 0.02% or less excluding 0%,
Al: 0.01% or less excluding 0%, and
Fe and inevitable impurities.

14. The spring steel according to claim 8, consisting of:
C: 0.5 to 0.8%,
Si: 1.2 to 2.5%,
Mn: 0.2 to 1.5%,
Cr: 1.5 to 4.0%,
V: 0.05 to 0.5%
P: 0.02% or less excluding 0%,
S: 0.02% or less excluding 0%,
Al: 0.0 1% or less excluding 0%,
Ni: 0.5% or less excluding 0%,
Mo: 0.4% or less excluding 0%, and
Fe and inevitable impurities.

* * * * *